US011008803B2

(12) United States Patent
Todd

(10) Patent No.: US 11,008,803 B2
(45) Date of Patent: May 18, 2021

(54) SECURITY DOOR ASSEMBLY

(71) Applicant: Hodgson Sayers Limited, Durham (GB)

(72) Inventor: Robert Edmund Todd, Northumberland (GB)

(73) Assignee: Hodgson Sayers Limited, Durham (GB)

( * ) Notice: Subject to any disclaimer, the term of this patent is extended or adjusted under 35 U.S.C. 154(b) by 252 days.

(21) Appl. No.: 16/307,417

(22) PCT Filed: Jun. 5, 2017

(86) PCT No.: PCT/GB2017/051605
§ 371 (c)(1),
(2) Date: Dec. 5, 2018

(87) PCT Pub. No.: WO2017/212228
PCT Pub. Date: Dec. 14, 2017

(65) Prior Publication Data

US 2019/0301234 A1 Oct. 3, 2019

(30) Foreign Application Priority Data

Jun. 6, 2016 (GB) ..... 1609829

(51) Int. Cl.
*E06B 3/70* (2006.01)
*E06B 5/11* (2006.01)

(52) U.S. Cl.
CPC ..... *E06B 3/70* (2013.01); *E06B 5/11* (2013.01); *E06B 2003/703* (2013.01); *E06B 2003/7051* (2013.01)

(58) Field of Classification Search
CPC ..... E06B 3/70; E06B 5/11–20; E06B 2003/7051; E05C 7/04
See application file for complete search history.

(56) References Cited

U.S. PATENT DOCUMENTS 3,432,966 A * 3/1969 Bordner ..... E06B 3/4609 49/368
4,294,040 A * 10/1981 Crotti ..... E06B 3/50 49/254

(Continued)

FOREIGN PATENT DOCUMENTS

CN 2429609 Y 5/2001
ES 1076688 U 4/2012

(Continued)

OTHER PUBLICATIONS

Loss Prevention Standard, LPS 1175: Issue 7.3, "Requirements and testing procedures for the LPCB approval and listing of intruder resistant buiding components, strongpoints, security enclosures and free-standing barriers," LPCB, BRE Global Ltd., Sep. 2015, 32 pages.

(Continued)

*Primary Examiner* — Justin B Rephann
(74) *Attorney, Agent, or Firm* — Workman Nydegger

(57) ABSTRACT

There is provided a security door leaf assembly, comprising a leaf frame structure, having at least a top rail member, a bottom rail member, a hinge stile member and a lock stile member; at least one inner leaf panel, removably mountable to a first side of said leaf frame structure; at least one outer leaf panel, removably mountable to a second side of said leaf frame structure, that is opposite to said first side; at least one first security-upgrade liner, and at least one first upgrade cavity, formed by said leaf frame structure, said at least one inner leaf panel and said at least one outer leaf panel, accessible via said at least one inner and/or outer leaf panel and adapted to removably receive and operatively affix said at least one first security-upgrade liner; and at least one first liner mount adapted to mount said at least one first security- (Continued)

(a)

(b)

upgrade liner in a predetermined position within said at least one first upgrade cavity.

13 Claims, 8 Drawing Sheets

(56) References Cited

U.S. PATENT DOCUMENTS 5,013,869 A * 5/1991 Breithaupt ..... E06B 5/18 174/368
5,349,782 A * 9/1994 Yulkowski ..... E05B 63/06 49/366
5,638,639 A * 6/1997 Goodman ..... A62C 2/24 292/21
5,660,021 A * 8/1997 Wolgamot ..... B32B 7/02 52/783.12
5,983,578 A * 11/1999 Huttie ..... E04H 9/06 109/1 S
6,655,760 B1 * 12/2003 Sakata ..... A47F 3/043 312/116
8,484,916 B2 * 7/2013 Farag ..... B32B 17/10055 52/235
2002/0046500 A1 * 4/2002 Hingston ..... E06B 5/11 49/501
2005/0166496 A1 * 8/2005 Farag ..... B32B 2333/12 52/204.57
2008/0202034 A1 * 8/2008 Campbell ..... E06B 1/6023 49/504
2008/0289547 A1 * 11/2008 Wakamatsu ..... E06B 5/11 109/76
2011/0061308 A1 * 3/2011 Badger ..... E06B 3/827 49/501
2012/0272601 A1 * 11/2012 Mouskis ..... E06B 3/7003 52/458
2014/0000193 A1 * 1/2014 Daniels ..... E06B 5/161 52/232
2014/0047785 A1 * 2/2014 Wilkinson ..... E06B 5/16 52/232
2015/0052835 A1 * 2/2015 Falter ..... E05C 9/042 52/204.1
2015/0152679 A1 * 6/2015 Kolobayev ..... E06B 7/24 49/305
2015/0159426 A1 * 6/2015 Kallay ..... E05G 1/08 49/70
2017/0030140 A1 * 2/2017 Nelson ..... E06B 5/20
2017/0299347 A1 * 10/2017 Fultz ..... E06B 3/5454

FOREIGN PATENT DOCUMENTS

GB 2401899 A 11/2004
WO WO-2009128068 A2 10/2009

OTHER PUBLICATIONS

Cobusneanu, D., "International Search Report," prepared for PCT/GB2017/051605, dated Aug. 7, 2017, three pages.

* cited by examiner (a)

(b)

(b)

(a)

SECURITY DOOR ASSEMBLY

The present invention relates to doors and in particular to security doors of the type that may be fitted in secure premises. Even more particular, the present invention relates to a security door assembly that is upgradable in accordance with a required security rating.

INTRODUCTION

Estate security is expensive to implement and maintain across a large regional or national geographic area, often because the dynamics of the threat can be locally influenced.

Threats are dynamic, thus frequently making existing security systems redundant before the capital expenditure has been amortized. Consequently, sites at heightened risk remain exposed for longer then necessary due to the natural reluctance to discard existing costly security equipment and replace it, so as to allow protection against the new threat.

Furthermore, nowadays, any type of information is instantly accessible via Internet based search engines and anybody can make themselves more familiar with suitable attack methods in order to try and gain access into secured premises and sites under risk may be forced to constantly improve and/or replace their security systems.

BRE Group, for example, provides correct specifications of approved security systems and products, which are put under rigorous testing programmes (LPCB approved) that evaluate their ability to both resist deliberate attacks and to operate reliably throughout their service lives. The so called Loss Prevention Standard LPS 1175 is one of the key security standards used for forced entry testing. The LPS 1175 test stipulates the allowable toolset and minimum time at each security rating level to prevent forcible entry through a building element (e.g. door, window etc.). The current security ratings are:

SR1: Opportunist attack by bodily force using minimal tools (e.g. screwdriver, knife, pliers etc.). Maximum work time: 1 minute; maximum test duration: 10 min SR2: More determined opportunist attack with tools of a higher mechanical advantage (e.g. SR1 tools plus bolt cutters, claw hammer, drill etc.). Maximum work time: 3 minute; maximum test duration: 15 min SR3: Deliberate forced entry of protected premises using bodily force and a selection of attack options (e.g. SR2 tools plus short axe, chisel, crowbar, gas torch etc.). Maximum work time: 5 minute; maximum test duration: 20 min SR4: Experienced attempts at forced entry with higher tool levels (e.g. SR3 tools plus felling axe, sledgehammer, steel wedges, disc grinder, jigsaw etc.). Maximum work time: 10 minute; maximum test duration: 30 min SR5: Serious attempt at forced entry with top end battery powered tools used by fire and rescue teams (e.g. SR4 tools plus circular saw, reciprocating saw), i.e. using state of the art cutting tools. Maximum work time: 10 minute; maximum test duration: 30 min In order to achieve a higher security rating, it is very common to simply replace the existing design with the same design but using thicker and more "exotic" materials, though, those "high-end" products are usually much more expensive than the replaced "lower-end" product.

For example, a level 2 door set may be removed and discarded (they are custom made for most openings) and replaced with an improved, but also considerably more expensive door set, i.e. the door leaf is made from a thicker/stronger material. Each security level upgrade is likely to be more expensive than the previous level and the overall cost can be considerable over the lifetime of the premises.

In addition, security "dogging" may also be provided from the outer surface of the door set, where the resulting gap between the wall and the frame is usually filled with a flexible sealant. However, in an attack, these bolts are simply cut through by gouging out the sealant. To minimise this weakness, diameter and strength of these "dogging" fixing bolts were simply increased, but the hole in the brickwork may become so big that the brickwork fixing fails so that the whole frame can be pulled out of the building without attacking the door at all.

Accordingly, it is an object of the present invention to provide a security door and security door system that is reasonably inexpensive when initially acquired at a lower security rating, and which is upgradable to any predetermined certified security rating without having to replace the whole security door system. Furthermore, it is an object of the present invention to provide a security door system with improved security.

SUMMARY OF THE INVENTION

Preferred embodiment(s) of the invention seek to overcome one or more of the above disadvantages of the prior art.

According to a first embodiment of the invention there is provided a security door leaf assembly, comprising:

- a leaf frame structure, having at least a top rail member, a bottom rail member, a hinge stile member and a lock stile member;
- at least one inner leaf panel, removably mountable to a first side of said leaf frame structure;
- at least one outer leaf panel, removably mountable to a second side of said leaf frame structure, that is opposite to said first side;
- at least one first security-upgrade liner, and
- at least one first upgrade cavity, formed by said leaf frame structure, said at least one inner leaf panel and said at least one outer leaf panel, accessible via said at least one inner and/or outer leaf panel and adapted to receive and operatively affix said at least one first security-upgrade liner; in that it includes at least one first liner mount adapted to mount said at least one first security-upgrade liner in a predetermined position within said at least one first upgrade cavity.

This provides the advantage that the originally installed security door leaf can be upgraded to a predetermined security level by removably installing one or more liners within a purpose-built upgrade cavity simply utilising the liner mount. The liner mount is adapted to receivingly engage with and position the liner so that it can be removably located at the required location within the door leaf assembly and will ensure that the security liner is positioned at the required location within the door leaf assembly ensuring the compliance with any certified security ratings. Also, after an attack, the unique modularity of the present invention makes it possible to repair a door assembly by simply replacing any one of the damaged parts, e.g. the leaf panel or the interior security liner(s), therefore, further reducing potential costs to maintain a high level of security.

Advantageously, the security door leaf assembly may comprise at least one second security-upgrade liner that is adapted to be mounted within said at least one upgrade cavity. Preferably, said at least one second security-upgrade liner and said at least one first security-upgrade liner may be operatively stackable into a substantially parallel arrangement, so that both said at least one first and second security-upgrade liner are removably mountable to the same said at least one first liner mount at said predetermined position. Advantageously, said at least one first security-upgrade liner and respective said at least one second security-upgrade liner may be arranged so as to provide a predetermined interspace when mounted to said at least one first liner mount. Preferably, said interspace may be adapted to receive at least one third security-upgrade liner.

This provides the advantage that a plurality of security liners can be matingly added to the same liner mount, therefore, providing an easy to use assembly for any one of a plurality of specified security levels (e.g. SR1 to SR4). For example, a level 4 liner may simply be fitted on top of an already installed level 3 liner. More liners may be added or exchanged for liners of different materials, so as to make an attack even more difficult. In addition, the interspace created by two matingly stacked security liners may also be filled with additional material that is sandwiched between the two security liners, adding further resistance to an attack. The material used may be specific to maximise resistance to a particular toolset.

In this preferred case, the assembly comprises a group of generically designed elements capable of being relationally located in such a way that when fixed together each particular combination can provide a variety of performance characteristics providing various levels of resistance to attack. Further, these co-existing relationships can be changed or augmented to adapt the equipment during the entire life-cycle of the product to further enhance its performance should the need arise to keep step with perceived changes of threat or environmental challenges. The interchangeable elements can be completely omitted in less demanding environments.

The system is designed so that these elements can be specified and fitted at outset or added to an installation during its working life without the existing need to discard an entire product and replace it with the entire 'new' suitable product. This brings significant cost reductions into play in a way that should promote more timely reaction to changing threats across an estate.

Up-gradability demands are such that the product has to allow the up-gradable features to be added in a way that is also fully compliant to the security demands in-effect at the time of deployment. The design of the product must be such that the act of up-grading should only involve procedures that do not detract from either the pre-existing or target levels of security being provided by the product. The core design must allow the delivery of this up-gradability on a remote site with managed and limited scope for works procedures as well as in factory controlled environments. Conventional production techniques dictate that once the product is assembled that part of the security being provided as achieved by ensuring that the product cannot be disassembled. The successful offering of up-gradability with this invention has overcome this conventional limitation.

Advantageously, the security door leaf assembly may further comprise a lock mount assembly adapted to selectively mount any one of a plurality of locks of different security standards. Preferably, said lock mount assembly may further comprise a security casing that is adapted to receive any one of said plurality of locks of different security standards.

Advantageously, the security door leaf assembly may further comprise any one of a cylinder guard and at least one exterior guard plate, each adapted to upgrade the resistivity of a lock mechanism to an attack.

According to a second embodiment of the invention there is provided a security door system, comprising:

- a door frame structure, having a head member, a sill member, a first jamb member and a second jamb member, adapted to be fixed to a building structure;
- an active security leaf assembly according to the first embodiment of the present invention that is hingedly mountable to said first jamb member, and
- an inactive security leaf assembly according to the first embodiment of the present invention that is hingedly mountable to said second jamb member; wherein said active security leaf assembly and said inactive security leaf assembly are adapted to interlockingly engage with each other when in a closed position.

Advantageously, said active security leaf assembly may comprise at least a first interleave member provided on a vertical edge of said active security leaf assembly, and said inactive security leaf assembly may comprise at least a second interleave member provided on a corresponding vertical edge of said inactive security leaf assembly; said first interleave member may be adapted to interlockingly engage with said second interleave member, when said active and inactive security leaf assemblies are in a closed position. Preferably, said first interleave member may be adapted to matingly receive at least a portion of said second interleave member. Even more preferably, said second interleave member may further compromise an abutment portion adapted to stoppingly engage with at least a portion of said vertical edge of said active security leaf assembly, when in a closed position.

This provides the advantage that the attack resistance of the locking edge of the closed door leafs is considerably improved, i.e. when an attacker tries to pry open the closed door leafs at the locking edge, interleave members of both the active and inactive door leaf are pushed towards each other further securing the locking edge of the active door leaf to the locking edge of the inactive door leaf. This means that, the harder an attacker tries to pry open the door, the harder it becomes to defeat the door.

Advantageously, each one of said active security door assembly and said inactive security door assembly may further comprise at least one third interleave member provided on at least one horizontal edge of said active security leaf assembly and at least one horizontal edge of said inactive security leaf assembly. Preferably, said third interleave member may be adapted to interlockingly engage with a corresponding guide member provided on said head member and/or said sill member and/or said first and said second jamb member of said frame structure.

This provides the advantage of improved resistance to an attack, in particular when the attacker tries to pry open the door(s) at the gap formed between the frame and the door edges. Any attempt to pry open the door at the edge(s) will result in pushing the horizontal edge(s) towards the corresponding horizontal guide member of the frame structure, therefore, increasing the locking engagement between the frame and the door.

BRIEF DESCRIPTION OF THE DRAWINGS

Preferred embodiments of the present invention will now be described, by way of example only and not in any limitative sense, with reference to the accompanying drawings, in which.

DETAILED DESCRIPTION OF THE PREFERRED EMBODIMENT(S)

The exemplary embodiments of this invention will be described in relation to a security doors and in particular a double-door security door system. However, it should be appreciated that, in general, the characteristic modular upgradability feature of the present invention will work equally well with any other security product configured to prevent a forced entry attack.

Figure 1:
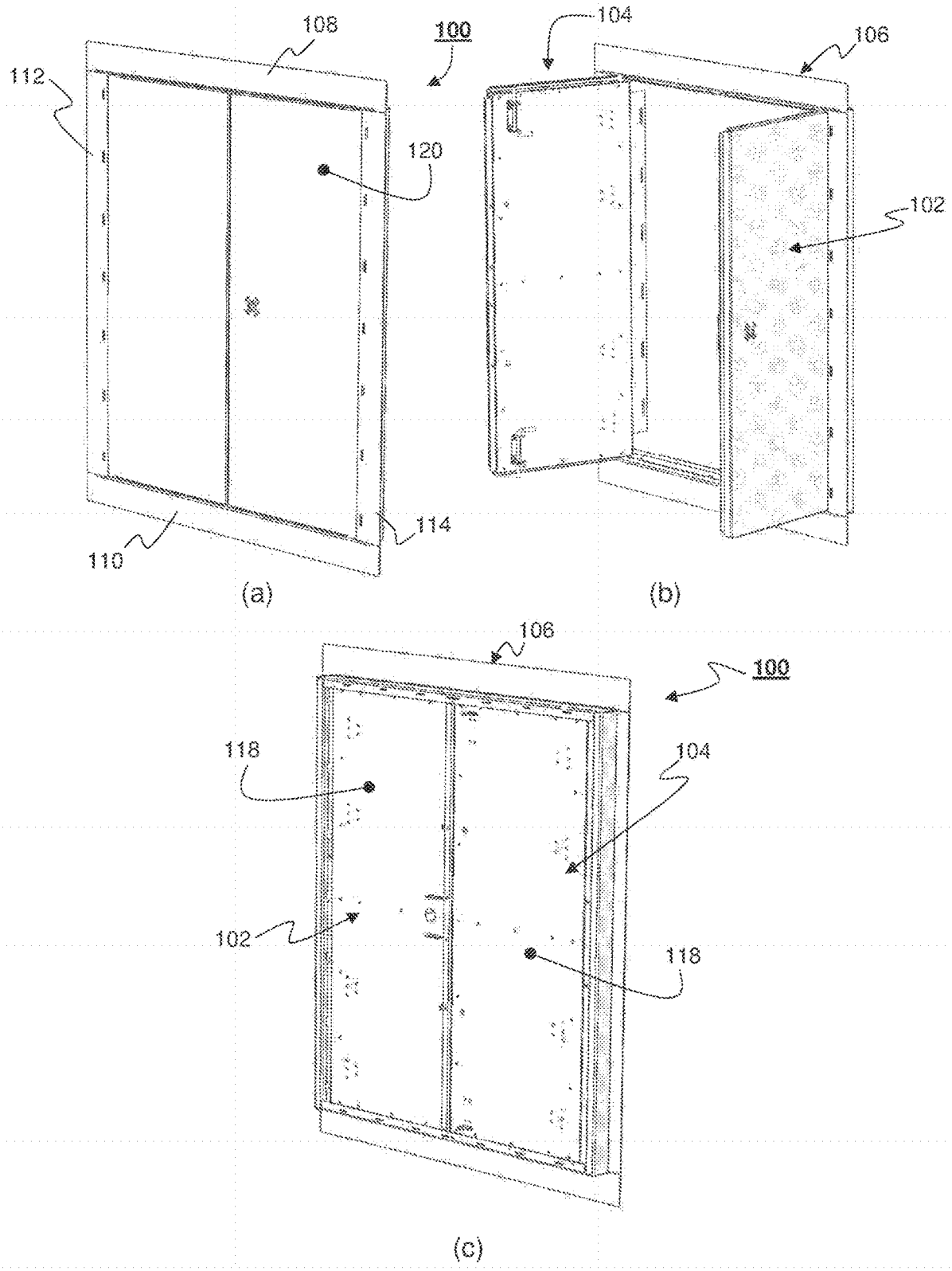
FIG. 1 shows an example of a security door system of the present invention including interlocking active and inactive door leaf assembly at (a) outside view when closed, (b) outside view when opened, and (c) inside view when closed.

Referring now to FIG. 1, a security door system 100 is shown in a closed position as seen from (a) the outside and (c) the inside, and (b) in an open position as seen from the outside (i.e. outside the premises). In this particular example embodiment, the security door system 100 is a double-door set having an active door leaf assembly 102 and an inactive door leaf assembly 104, and a frame structure 106 that comprises a head member 108, a sill member 110 and two jamb members 112 and 114. The frame structure 106 may be fitted within a rebate of a wall of a building structure (not shown). In one particular example, the frame fixings (not shown) may be located to the inside of the building structure, so that any attack would have to start with significant amounts of cutting and drilling to simply gain access to the fixings, i.e. the fixing bolts are even further removed from the attack face. Furthermore, a fascia plate (not shown) may be used at the front (outside) of the frame structure 106 to prevent access to the wall fixings and make good any potential physical deficiencies (e.g. gaps, broken brickwork and lintels) in the wall structure of the building into which the security door system 100 is being fitted.

Security Up-Grades

Figure 2:
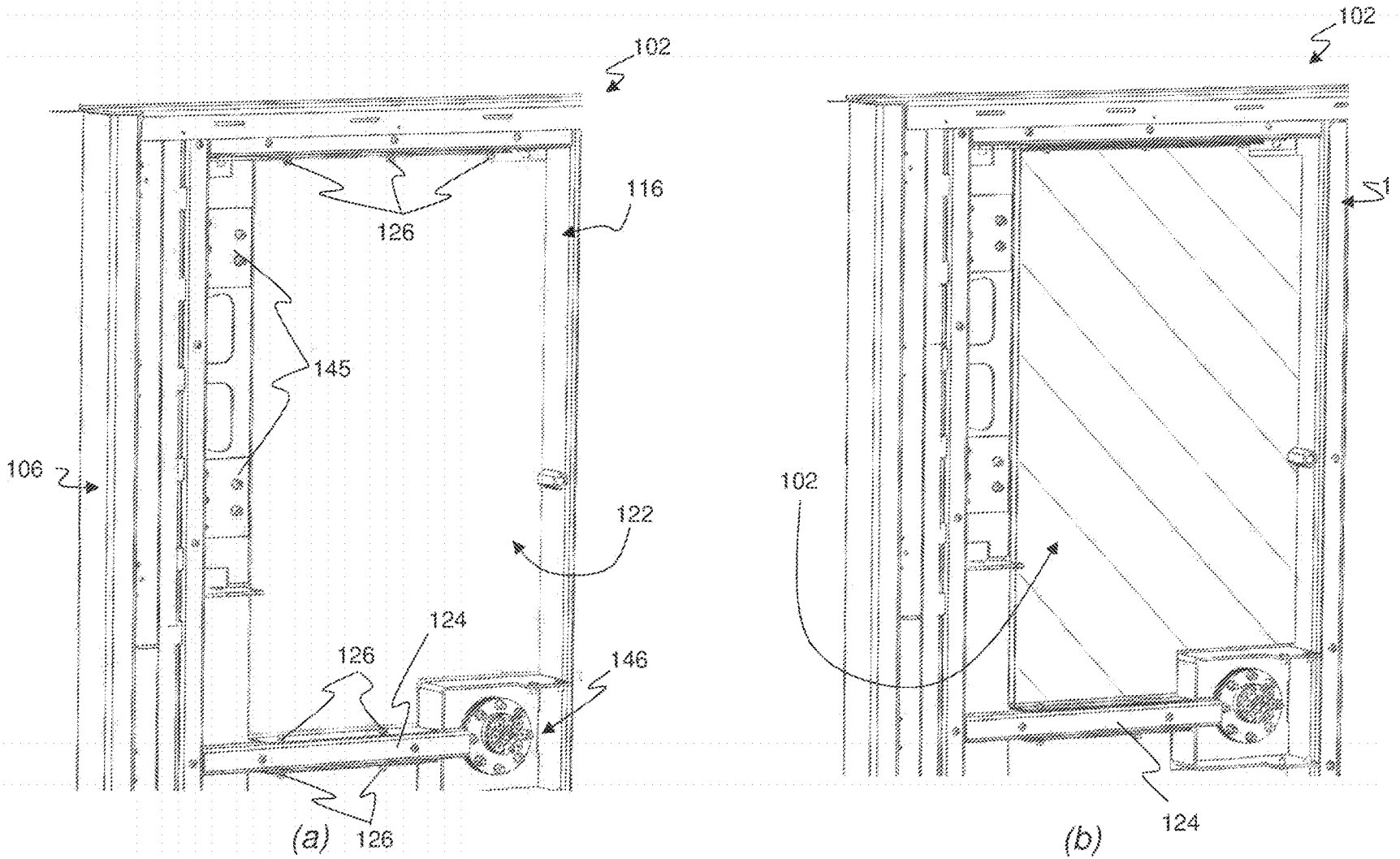
FIG. 2 shows a cavity portion of a security door leaf assembly with its leaf panel removed and (a) a level 3 upgrade security liner installed to the mount within the cavity, and (b) a level 4 upgrade security liner matingly stacked on top of the level 3 upgrade security liner and installed to the mount within the cavity.
Figure 3:
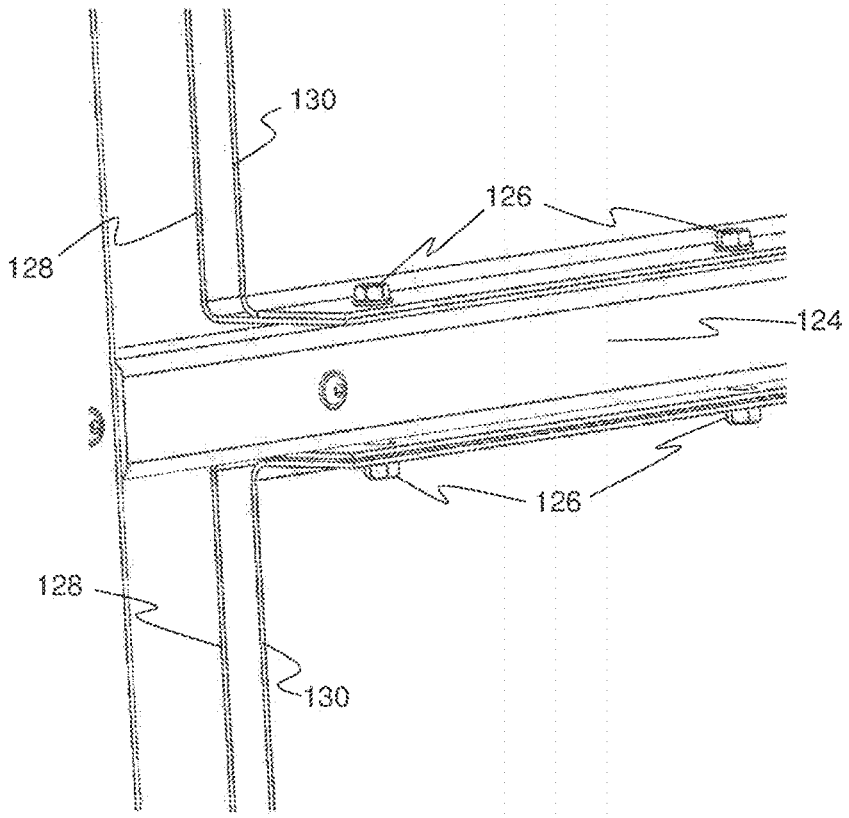
FIG. 3 shows a close-up partial view of the security door leaf assembly of FIG. 2 (b), showing (a) a first mount within a respective cavity of the security door leaf assembly and (b) a second mount within the cavity of the security door leaf assembly.
Figure 3:
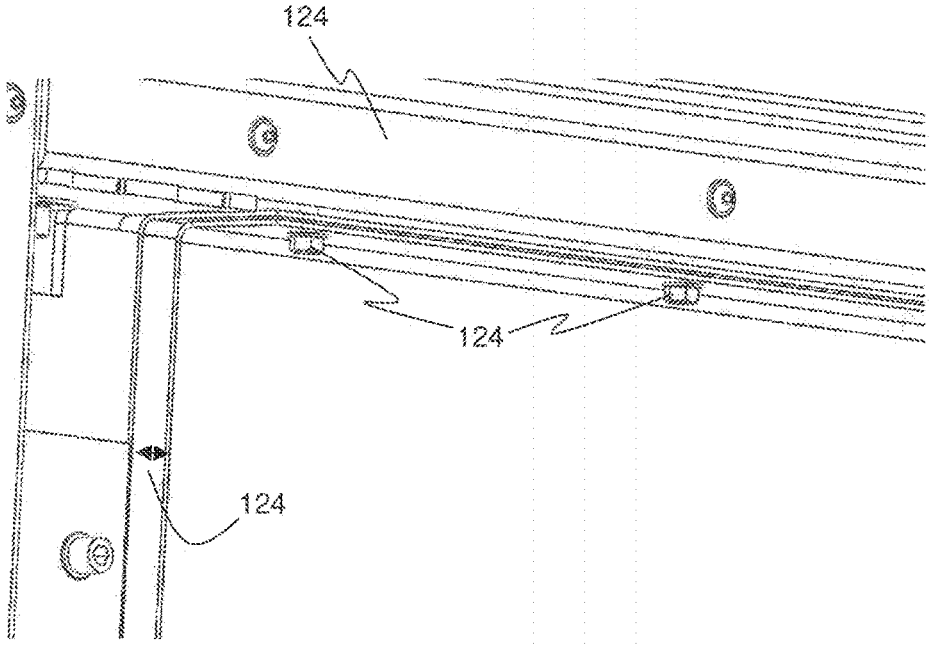
Figure 4:
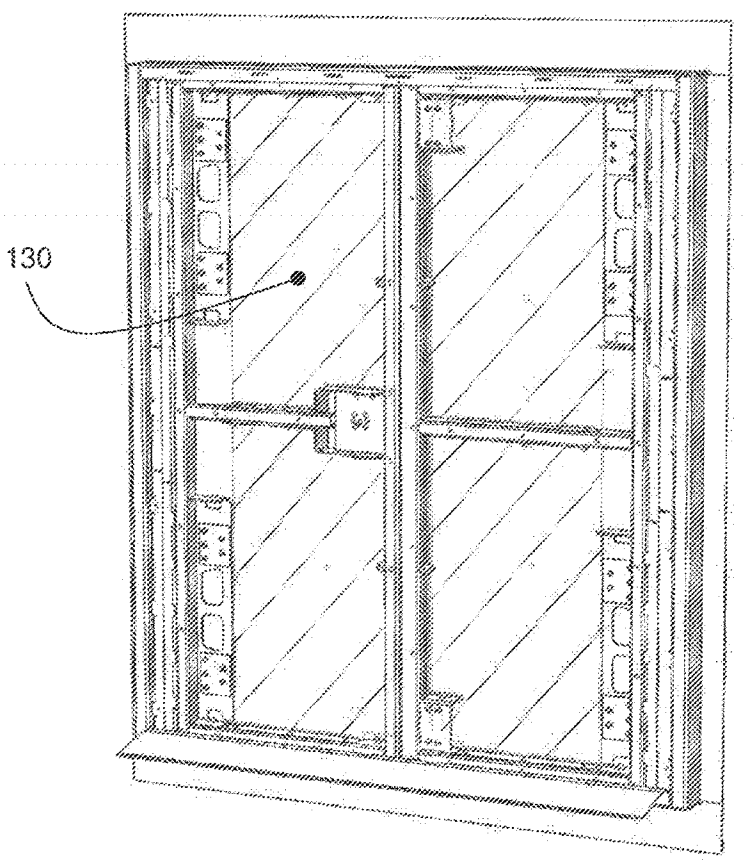
FIG. 4 shows the security door assembly of FIG. 1 with the leaf panels removed from the active and inactive security door leaf assembly, exposing (a) level 3 upgrade security liners installed on corresponding mounts within the cavities, and (b) level 4 upgrade security liners stacked with respective level 3 upgrade security liners and installed on corresponding mounts within the cavities.
Figure 4:
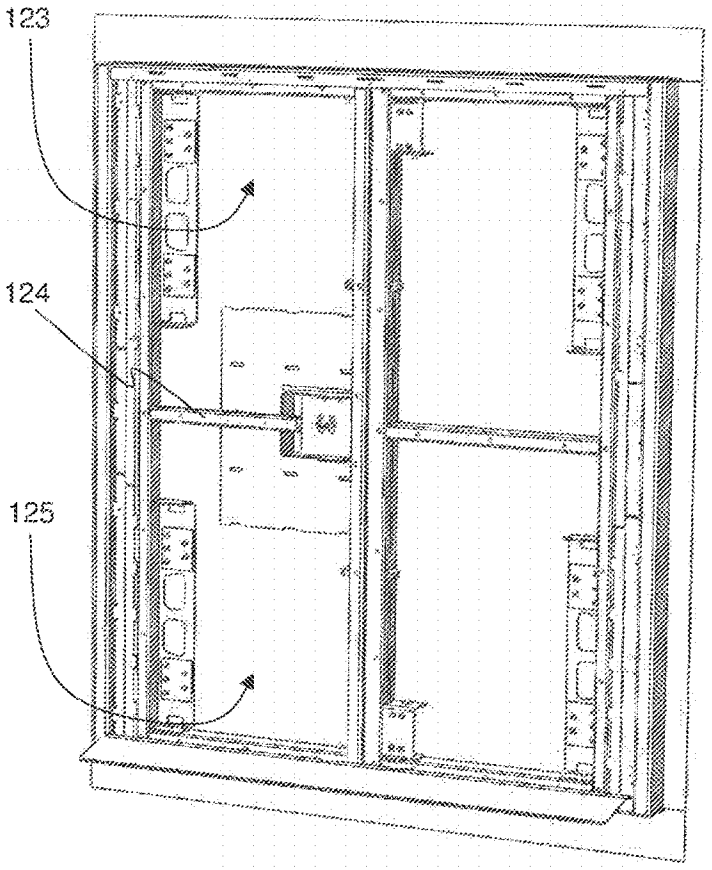

As shown in the example embodiment illustrated in FIGS. 2, 3 and 4, each door leaf assembly 102, 104 comprises a leaf frame structure 116, an inner leaf panel 118 and outer leaf panel 120. The inner and outer leaf panels 118, 120 and the frame structure 116 form at least one cavity 122. In this particular example, a locking rail 124 is installed to the leaf frame structure 116, so as to divide the cavity 122 into two separate cavities, e.g. cavity 123 and cavity 125. However, it is understood by the person skilled in the art, that the dividing rail 124 is not an essential feature, and each door leaf assembly 102, 104 may only comprise one cavity 122. Alternatively, additional rails may be installed to form a plurality of additional cavities within the door leaf assembly 102, 104, when assembled. Furthermore, suitable liner mounts 126 are provided at the top rail member and bottom rail member of the leaf frame structure 116, as well as, both sides of the locking rail 124. It is understood that liner mounts 126 may be provided at any other suitable location of the leaf frame structure 116.

In the event an upgrade is needed, e.g. from a level 2 to a level 3 or 4 (LPC 1175), suitable security liners 128, 130 may be installed within any of the formed cavities 122, 123, 125 in any one of the two door leaf assemblies 102, 104.

For example, in order to upgrade a door leaf assembly 102, 104 from an initial security level 2 to a security level 3, a first security liner 128 is installed into any cavity 122, 123, 125 via corresponding mounts 126, ensuring that as the risk changes the door leaf assembly 102, 104 can counter the evolving threat. In this particular example, the first security liner 128 may be 2 mm thick steel liner that is bolted within the cavity 122, 123, 125 between the inner and outer leaf panel 118, 120. Alternatively, the security liner 128 may be fitted loosely, as long as it is captive between the inner and outer leaf panel 118, 120.

To upgrade a level 3 door leaf assembly 102, 104 to a security level 4, a second security liner 130 is stackingly combined with the first liner 128 and installed to the same corresponding mounts 126. In particular, first and second security liner 128, 130 may be formed in such a way that, when installed on the same corresponding mounts 126, a predetermined interspace 132 is formed between the first and second security liner 128, 130, when in situ. Additional material (not shown, e.g. wood or any other attack specific material) may be provided within that interspace 132, i.e. sandwiched between the first and second security liner 128, 132, therefore, providing further resistance to an attack. The material of any one of the security liners 128, 132 and of the additional material may be selected, so as to be particular effective for a specific attack (i.e. tool).

Security "Dogs"

Figure 5:
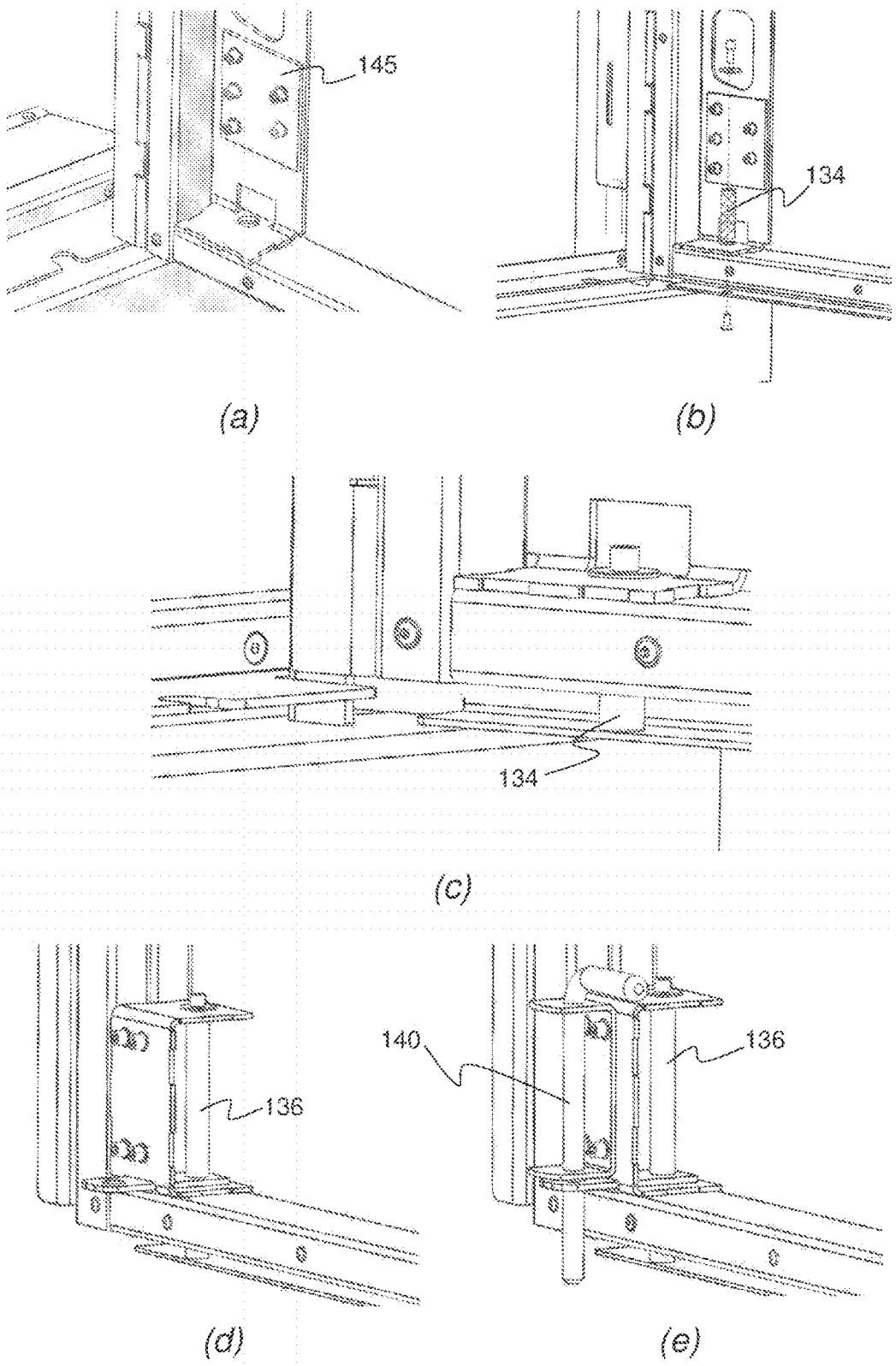
FIG. 5 shows a portion of the hinge edge of the security door leaf assembly (door leaf removed) with (a) no locking dogs fitted, (b) an exploded view of locking dog being fitted to the hinge edge of the security door leaf assembly, (c) fitted locking dog to the hinge edge of the security door leaf assembly, (d) a locking dog fitted to the bolt edge of the security door leaf assembly, and (e) a locking bolt fitted to the installed locking dog.
Figure 6:
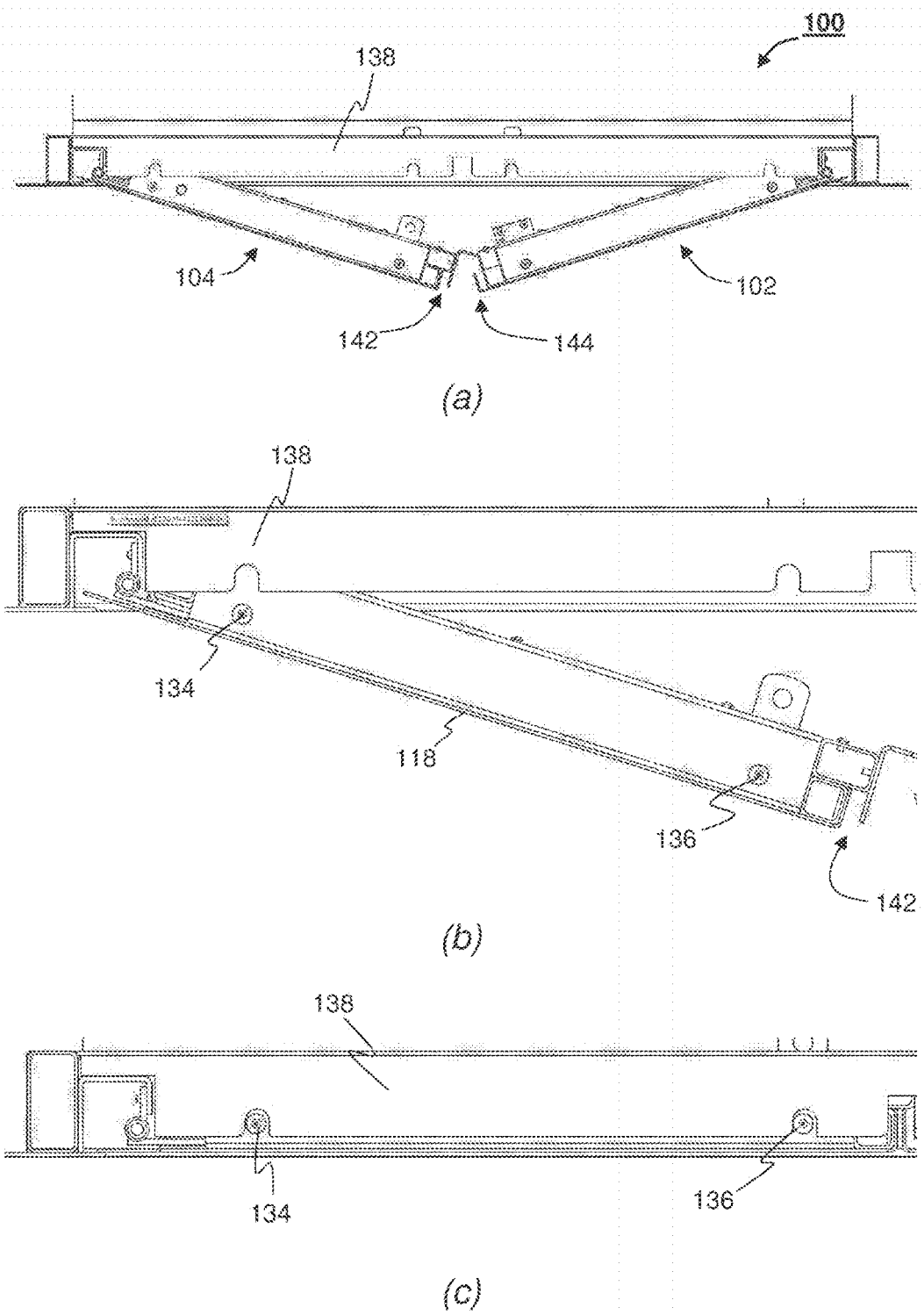
FIG. 6 shows a top or bottom view of the security door assembly of FIG. 1 (a) open active and inactive security door leaf assembly each with locking dogs fitted to the hinge edge and bolt edge of the door, (b) a close-up view of the open inactive security door leaf assembly with fitted locking dogs at the hinge edge and bolt edge of the door, and (c) a close-up view of the closed inactive security door leaf assembly with the fitted locking dogs engaged with corresponding openings of a respective frame guide member.
Figure 7:
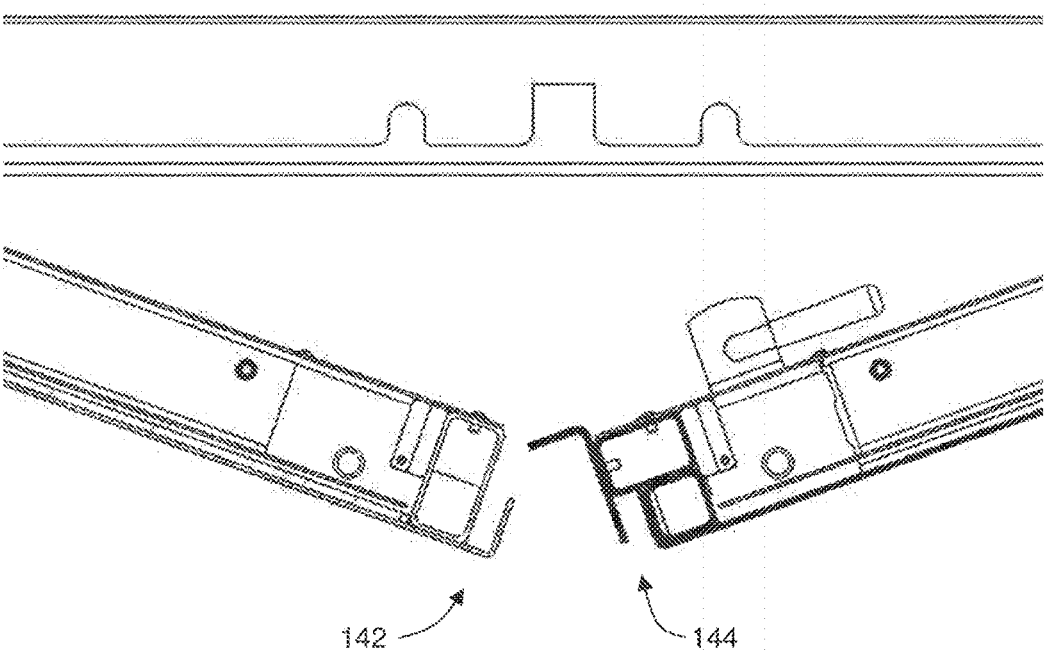
FIG. 7 shows the first and second interleave member when the door is in an open position.
Figure 8:
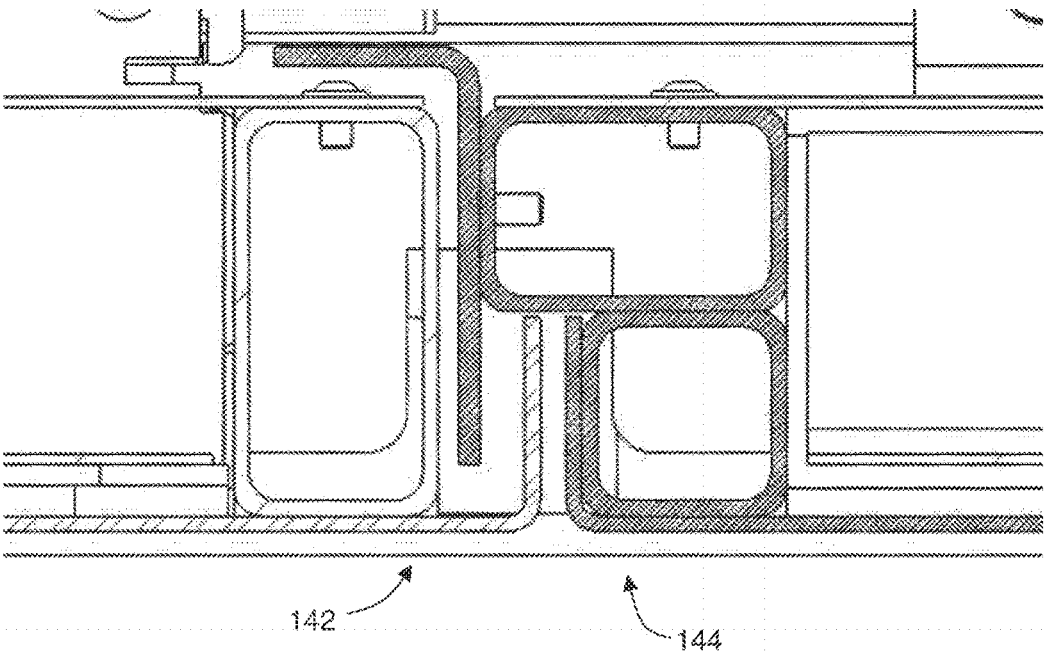
FIG. 8, shows a close-up of the first and second interleave member when the door is in a closed position, so that the first and second interleave members are sealingly engaged.

Referring now to FIGS. 5 and 6, when upgrading the security door assembly 100 to level 3 or 4, horizontally acting "dogs" 134, 136 are provided on each door leaf assembly 102, 104. In this particular example embodiment, there are two "dogs" 134, 136 fitted to the top rail member and bottom rail member of the leaf frame structure 116, which act by engaging with corresponding guides 138 of the frame structure 106 when in a closed position. The "dogs" 134, 136 prevent force being applied between the door (i.e. door leaf assembly 102, 104) and the outer frame structure 106 during lever and crow-bar attacks. When installing the "dogs" during an upgrade, a first "dog" 134 is fitted to the hinge edge of the door leaf assembly 102, 104 (FIG. 5 (b), (c)) and a second, longer "dog" 136 is fitted to the bolt edge of the door leaf assembly 102, 104 (FIG. 5 (d), (e)). A locking bolt 140 may also be mounted to the bolt edge of the door leaf assembly 102 and/or 104.

As mentioned above, the outer leaf panel 118, 120 is formed so as to interleave with a guide 138 of the frame structure 106 when in a closed position, making any attack significantly harder to start as there is no gap between the door leaf assemblies 102, 104 and the frame structure 106. The door leaf assemblies 102, 104 when closed also become bigger than the hole into which they fit, they do this by "wrapping" around the rear of the door frame 106 as part of particular hinge action, so any attempt to pull the doors out has to also pull the frame out of the wall.

Interleaved Door Edges

Referring to FIGS. 6 (a), (b) and (c), 7 and 8, the outer leaf panel 118 of the inactive door leaf assembly 104 is formed so as to create a first interleave member 142 adapted to matingly interlock with a corresponding second interleave member 144 that is formed by outer leaf panel 118 of the active door leaf assembly 102. By interleaving the locking edge of active and inactive door leaf assembly 102, 104, any attack (e.g. by crow-bar) would result in further securing one door leaf assembly 102 or 104 to the corresponding other door leaf assembly 104 or 102, i.e. the harder an attacker tries to pry open the door 100 via the interleaved locking edges of the closed door leaf assemblies 102, 104, the harder it becomes to defeat the door 100.

Concealed Hinges

In this particular example embodiment, each of the two basic level 2 security door leaf assemblies 102, 104 has two hinges 145 at an upper portion and a single hinge 145 at a lower portion of the hinge stile member of the leaf frame structure 116. When upgraded to a level 4 security door, the each of the two door leaf assemblies 102, 104 has two hinges 145 at an upper portion and two hinges 145 at a lower portion of the hinge stile member of the leaf frame structure 116. Preferably, the hinges 145 are concealed in such a way that it is not possible to attack the hinges without first attacking the outer door leaf panel 120.

Modular Locking

Figure 9:
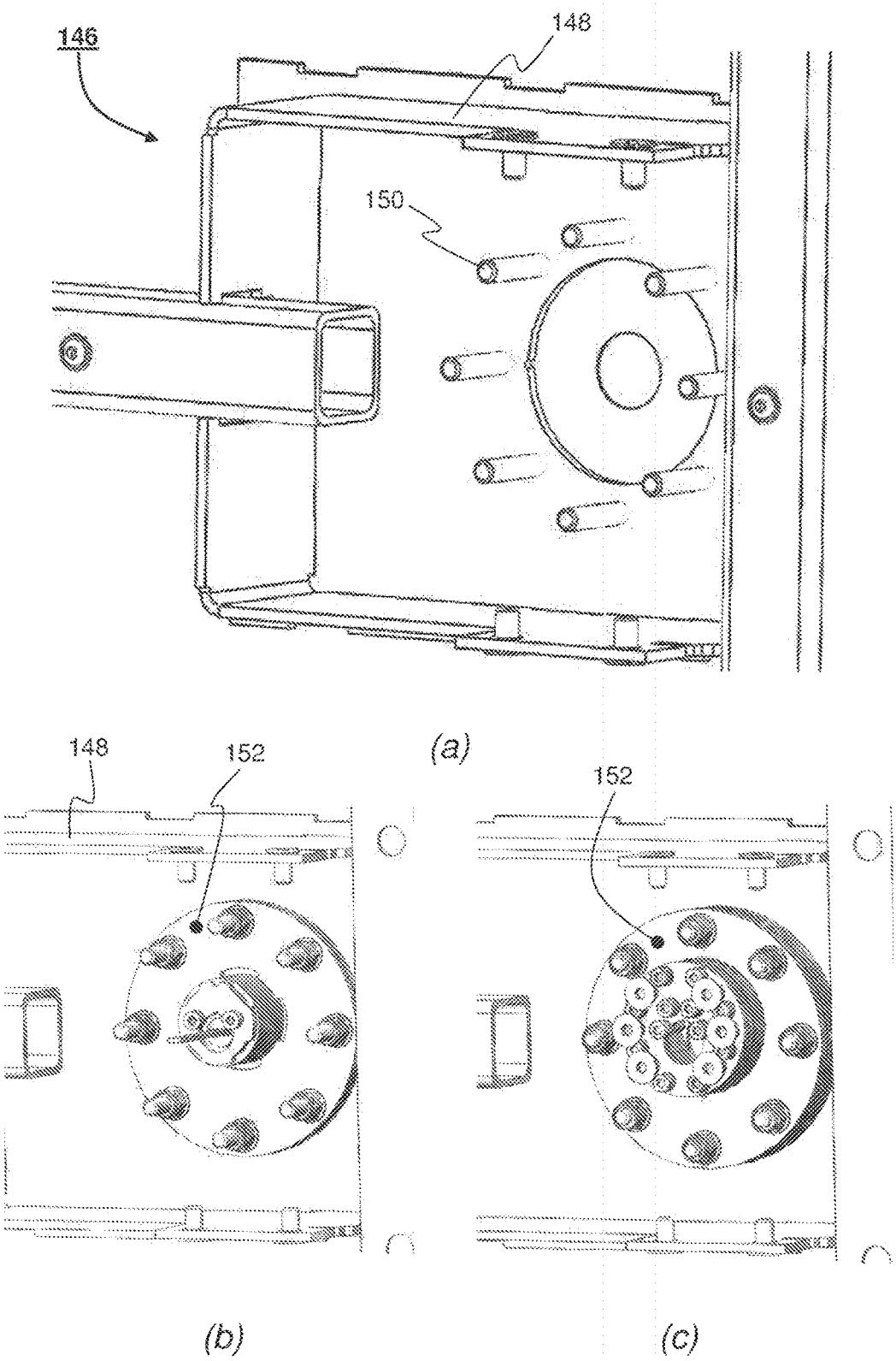
FIG. 9 shows a lock mount assembly (a) open and before upgrade, (b) with a first level 4 cylinder and guard assembly bolted to the lock mount assembly, and (c) with a second level 4 cylinder and guard assembly bolted to the lock mount assembly.

Referring now to FIG. 9, the door leaf assemblies 102, 104 of the present invention are adapted to incorporate almost any 3$^{rd}$ party lock within its modular lock mount assembly 146. The lock mount assembly 146 comprises a housing (or cassette) 148 and standardised lock mounts 150, as well as, an interchangeable cylinder guard 152. FIG. 9 (b) and (c) shows two different cylinder guard upgrades installed with the lock mount assembly 146.

Example Guide and Fitting Instructions for LPC 1175 Level SR3 Upgrade

This guide shows how to locally upgrade the equipment to level SR3 at the time of installation or as a retrospective upgrade.

Upgrade Components:

SR3 Trailing door upgrade fittings
1 qty 1502.HAA.131.1014 Liner
1 qty 1502.HAA.131.1015 Liner
12 qty M6×22 mm Self drilling and tapping screw
SR3 Locking door upgrade fittings
1 qty 1502.HAA.131.1034 Liner
1 qty 1502.HAA.131.1035 Liner
10 qty M6×22 mm Self drilling and tapping screw
SR3 Lock upgrade
1 qty SR4 Lock assembly
4 qty M8×20 mm C/S Allen Pre-Fitting Checks:

Verify the Site Survey Report details and measure the door sizes at the site and compare to the size specified on the upgrade kit. If the parts are NOT intended for the site abort the session.

Preparation:

Release the two sprung bolts and un-bolt them from the doors. Un-bolt and remove the SR2 lock assembly.

Remove the Inner Leaf Panel:

Remove the M6 Flanged bolts that hold the inner leaf panel to the door and store them safely in a container for re-fitting later. The door has to be open to do this as the bolts are partially shrouded by the frame and the trailing edge overlap profile.

Remove the Door Lock:

Remove the M8 C/S bolts that hold the lock to the door and store them safely in a container for re-fitting later.

Remove the Inner Leaf:

Remove the M6 Flanged bolts that hold the inner leaf panel to the door and store them safely in a container for re-fitting later. The door has to be open to do this as the bolts are partially shrouded by the frame and the trailing edge overlap profile.

Door Liner Installation:

Fit the security liners into the door cavity as shown in FIGS. 2, 3 and 4. Then using a power drill with a suitable drive socket, drive the self drilling and self tapping fixing bolts into the box sections (top and bottom) as shown above. Fix the dog to the door outer leaf panel with the M8 C/S screw and then fit the M8 Cap bolt and washer then tighten them fully to retain the dog in place.

Repeat this at the top of the door and check that the door opens and closes properly with the dogs locating correctly into the recesses in the top and bottom frame overlaps. DMDE liners are each fitted with six bolts whereas DADE liners are fitted with five bolts each.

Re-Fitting Inner Door Leaves:

Start by fitting the inner leaf onto the fixed door and fix it in place with the flanged button head screws that were set aside earlier. Then, re-fit the two spring bolt units with the spring washers and cap screws. Check that the door opens and closes properly and that the spring bolts fit into the frame correctly to secure the door. Next fit the inner leaf panel onto the access door and fix this in-place with the original flanged button head screws.

Fitting the SR4 Lock:

Offer-up the SR4 lock assembly to the door making sure that the cylinder tang enters the lock drive-shaft. Finally locate the lock assembly into the lock guard assembly and fix in place with the four M8×16 mm screws provided. Test the operation of the doors and make sure that the lock operates properly from both inside and outside faces of the door. Check the operation of the lock with the door open and closed.

Example Guide and Fitting Instructions for LPC 1175 Level SR4 Upgrade

This guide shows how to locally upgrade the equipment to level SR3 at the time of installation or as a retrospective upgrade.

Upgrade Components:

SR4 door upgrade fittings
1 qty 1502.HAA.131.1027 Liner
1 qty 1502.HAA.131.1028 Liner
1 qty 1502.HAA.131.1032 Liner
1 qty 1502.HAA.131.1033 Liner
SR4 Lock upgrade fittings
1 qty 1507.HAA.114.1004 SR4 Cylinder assy
1 qty 1509.HAA.114.1005 SR4 Lock keep
1 qty 1509.HAA.134.1006 SR4 Lock guard plate
6 qty CTL-646-4116M M16 Form B
4 qty CTL-630-0254E M16×40 Hex set
4 qty CTL-604-2072E M8×16 C/S Allen
SR4 DMDE Dog upgrade fittings
6 qty 1502.HAA.131.1025 Short dog
2 qty 1502.HAA.131.1026 Long dog
8 qty QFT-604-2074G M8×20 mm C/S Allen
8 qty QFT-600-1008N M8×20 mm Cap Allen
8 qty CTL-645-2014P M8 Repair washers
SR4 Hinge upgrade fittings
2 qty 1502.HAA.122.1005 Hinge assemblies
2 qty 1501.HAA.132.1029 Hinge clamp plate
8 qty QFT-604-2074G M8×20 mm C/S Allen
10 qty QFT-600-1008N M8×20 mm Cap Allen
10 qty CTL-645-1708H M8 Spring washers Pre-Fitting Checks:

Verify the Site Survey Report details and measure the door sizes at the site and compare to the size specified on the upgrade kit. If the parts are NOT intended for the site abort the session.

Preparation:

Release the two sprung bolts and un-bolt them from the doors. Un-bolt and remove the SR2 lock assembly.

Remove the Inner Leaf Panel:

Remove the M6 Flanged bolts that hold the inner leaf panel to the door and store them safely in a container for re-fitting later. The door has to be open to do this as the bolts are partially shrouded by the frame and the trailing edge overlap profile.

Remove the Door Lock;

Remove the M8 C/S bolts that hold the lock to the door and store them safely in a container for re-fitting later. The door has to be open to do this as the lock has to slide towards the door edge to release it from the mounting bracket and the trailing door edge will prevent this if the trailing door is closed.

Remove the Inner Leaf;

Remove the M6 Flanged bolts that hold the inner leaf to the door and store them safely in a container for re-fitting later. The door has to be open to do this as the bolts are partially shrouded by the frame and the trailing edge overlap profile.

Hinge Installation (Repeat for BOTH Doors):

1 qty 1502.HAA.101.1014 SR4 Upgrade kit

Remove the M8 screws securing the bottom hinge to the frame and support or jack the bottom of the door away from the frame to create a gap through which the hinge can be fitted. Fix the hinge loosely to the door using the M8 cap bolts and washers then fix the hinge to the frame using the M8 C/S bolts, fully tighten these bolts. Replace the C/S bolts to hold the bottom hinge in-place then return to the cap bolts in the new hinge and tighten them fully.

Short Dog Installation;

SR4 Short Dog upgrade

Slide the dog into position in the hinge area of the door as shown in the call-out above making sure that the end of the dog with the chamfer mates to the inside face of the outer door leaf. Fix the dog to the door outer leaf with the M8 C/S screw and then fit the M8 Cap bolt and washer then tighten them fully to retain the dog in place. Repeat this at the top of the door to complete the second fixing.

Long Dog Installation;

SR4 Long Dog upgrade

Slide the long dog into position in the inactive door making sure that the end of the dog with the chamfer mates to the inside face of the outer door leaf. Fix the dog to the door outer leaf with the M8 C/S screw and then fit the M8 Cap bolt and washer then tighten them fully to retain the dog in place.

Long Dog Installation;

SR4 Short Dog upgrade

Slide the short dog into position in the inactive door making sure that the end of the dog with the chamfer mates to the inside face of the outer door leaf. Fix the dog to the door outer leaf with the M8 C/S screw and then fit the M8 Cap bolt and washer then tighten them fully to retain the dog in place.

Door Liner Installation;

Level 4 Door upgrade liners

Slacken the bolts in each level 3 security liner then place the level 4 security liner into the level 3 security liner. Next fix the liners in place with the mounting screws.

Cylinder Guard Removal;

Remove the SR2/3 cylinder and guard from the housing by un-bolting the nyloc nuts.

SR4 Cylinder Guard Installation;

Level 4 Door cylinder guard

Fit the SR4 cylinder guard clamping the cylinder guard in-place using the clamp plate and the new M8 spring clips and Nyloc nuts. Complete the assembly by fitting the rear guard plate fixing it in place with the M6 C/S bolts provided with the cylinder guard.

Re-Fitting Inner Leaves;

Start by fitting the inner leaf panel onto the fixed door and fix it in place with the flanged button head screws that were set aside earlier. Then, re-fit the two spring bolt units with the spring washers and cap screws. Check that the door opens and closes properly and that the spring bolts fit into the frame correctly to secure the door. Finally fit the inner leaf panel onto the access door and fix this in-place with the original flanged button head screws.

Fitting the SR4 Lock-Guard:

Start by removing the M6 Allen bolt shown and fit the guard, loosely refit the M6 screw then fit two M16 washers and an M16 bolt to the top mounting hole and repeat this in the bottom hole. Locate one of each pair of washers behind the guard plate and the other in front of the guard plate to form a sandwich. Tighten the bolts to hold the guard panel in-place.

Fitting the SR4 Lock Keep:

Fix the keep to the fixed door overlap edge using the M8×16 mm C/S bolts provided. Do not fully tighten these bolts yet. Now fit the M16 bolts and washers to hold the assembly to the inside face of the door as shown. Now tighten all of the bolts fully.

Fitting the SR4 Lock:

Fit the lock assembly to the door using the M8×16 mm C/S bolts provided. Fully tighten the bolts. Now check the operation of the lock with the door in the open position, if satisfactory now repeat the tests on the lock with the door in the closed and secure position. The lock blade should slide easily into and out of position in the door keep on the passive leaf.

It is important that the design features that allow the leafs and security liners to become removable and/or interchangeable must be accomplished in a way that does not reduce the resilience of the door structure to an attack at existing levels and still allows the removable element to be upgraded as well to support a future element.

So for example:

SR1: The leaf design only requires 16 off 4 mm aluminium rivets to hold the inner leaf in-place to provide compliant resistance to attacks at SR1 severity. The design of where to place those rivets is the trick. We place them in alternate holes that are pre-drilled in the edges of the door leaf to provide:

A more aesthetically appealing product

These edges also have the benefit of not being accessible when the door(s) are closed Forces applied during an attack cannot simply 'pull-out' the rivets they have to be sheared as the attack forces can only be applied in the shearing direction.

SR2: The leaf design only requires 32 off 4 mm aluminium rivets to hold the inner leaf in-place to provide compliant resistance to attacks at SR2 severity. The design of where to place those rivets is the trick. We place the original 16 in the previously used alternate holes and then we fit the extra 16 rivets in alternate holes that were previously unused. All holes are pre-drilled in the edges of the door leaf to retain the previously described benefits.

SR3: Once any other up-grade elements are fitted the 32 off 4 mm aluminium rivets holding the inner leaf in-place are replaced with 5 mm equivalents provide compliant resistance to attacks at SR3 severity. The design will further support the use of even larger rivets or the use of stainless steel rivets should the perceived threat demand their use:

The fundamental feature of this design is that the rivets are never accessible to an attacker within the scope of each attack. An increase in size or use of alternate material is therefore the only incremental change required to address the need for future improved security. This is effective as the forces are restricted to the shear orientation.

It will be appreciated by persons skilled in the art that the above embodiment(s) have been described by way of example only and not in any limitative sense, and that various alterations and modifications are possible without departing from the scope of the invention as defined by the appended claims.

The invention claimed is:

1. A security door leaf assembly comprising:

a leaf frame structure, having at least a top rail member, a bottom rail member, a hinge stile member and a lock stile member;

at least one inner leaf panel, selectively removably mountable to a first side of the leaf frame structure;

at least one outer leaf panel, selectively removably mountable to a second side of the leaf frame structure, that is opposite to the first side;

at least one first security liner;

at least one first cavity, formed by the leaf frame structure, the at least one inner leaf panel and the at least one outer leaf panel, accessible via the at least one inner or outer leaf panel when the at least one inner or outer leaf panel is selectively removed from the leaf frame structure and adapted to receive and operatively affix the at least one first security liner; and at least one first liner mount adapted to mount the at least one first security liner in a predetermined position within the at least one first cavity.

2. The security door leaf assembly according to claim 1, wherein the liner mount is adapted to receivingly engage with and position the at least one first security liner so that it can be removably located at the predetermined location within the door leaf assembly.

3. The security door leaf assembly according to claim 1, comprising at least one second security liner, adapted to be mounted within the at least one first cavity.

4. The security door leaf assembly according to claim 3, wherein the at least one second security liner and the at least one first security liner are operatively stackable into a substantially parallel arrangement, so that both the at least one first and second security liners are mountable to the same at least one first liner mount at the predetermined position.

5. The security door leaf assembly according to claim 4, wherein the at least one first security liner and respective at least one second security liner are arranged so as to provide a predetermined interspace when mounted to the at least one first liner mount.

6. The security door leaf assembly according to claim 1, further comprising a lock mount assembly adapted to selectively mount any one of a plurality of locks.

7. The security door leaf assembly according to claim 6, wherein the lock mount assembly further comprises a security casing adapted to receive any one of the plurality of locks of different security standards.

8. The security door leaf assembly according to claim 1, further comprising any one of a cylinder guard and at least one exterior guard plate, each adapted to increase a resistivity of a lock mechanism to breach of the lock mechanism.

9. A security door system comprising:

a door frame structure, having a head member, a sill member, a first jamb member and a second jamb member, adapted to be fixed to a building structure;

an active security leaf assembly according to claim 1 that is hingedly mountable to the first jamb member;

an inactive security leaf assembly according to claim 1 that is hingedly mountable to the second jamb member; and wherein the active security leaf assembly and the inactive security leaf assembly are adapted to interlockingly engage with each other when in a closed position.

10. The security door system according to claim 9, wherein the active security leaf assembly comprises a first interleave member provided on a vertical edge of the active security leaf assembly, the inactive security leaf assembly comprises a second interleave member provided on a corresponding vertical edge of the inactive security leaf assembly, and the first interleave member is adapted to matingly engage with the second interleave member, when the active and inactive security leaf assemblies are in a closed position.

11. The security door system according to claim 10, wherein the first interleave member is adapted to interlockingly receive at least a portion of the second interleave member.

12. The security door system according to claim 9, wherein each one of the active security door assembly and the inactive security door assembly further comprise at least one third interleave member provided on at least one horizontal edge of the active security leaf assembly and at least one horizontal edge of the inactive security leaf assembly.

13. The security door system according to claim 12, wherein the third interleave member is adapted to interlockingly engage with a corresponding guide member provided on the head member or the sill member or the first and the second jamb member of the frame structure.

* * * * *